US007063406B2

(12) United States Patent
Eguehi et al.

(10) Patent No.: US 7,063,406 B2
(45) **Date of Patent: *Jun. 20, 2006**

(54) PRINTER HEAD CHIP AND PRINTER HEAD

(75) Inventors: Takeo Eguehi, Kanagawa (JP); Minoru Kohno, Tokyo (JP); Shinichi Horii, Kanagawa (JP); Takumi Namekawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/993,234

(22) Filed: Nov. 19, 2004

(65) Prior Publication Data

US 2005/0088489 A1 Apr. 28, 2005

Related U.S. Application Data

(62) Division of application No. 10/236,449, filed on Sep. 6, 2002, now Pat. No. 6,874,865.

(30) Foreign Application Priority Data

Sep. 10, 2001 (JP) ..... 2001-273032
Sep. 10, 2002 (JP) ..... 2001-273040

(51) Int. Cl.
*B41J 2/05* (2006.01)

(52) U.S. Cl. ..... 347/65; 347/42; 347/43; 347/49

(58) Field of Classification Search ..... 347/65, 347/42, 43, 49
See application file for complete search history.

(56) References Cited

U.S. PATENT DOCUMENTS 5,469,199 A 11/1995 Allen et al.
6,663,223 B1 12/2003 Horii et al.
6,874,865 B1 * 4/2005 Eguchi et al. ..... 347/42

FOREIGN PATENT DOCUMENTS

JP 2000-218803 8/2000
JP 2001-130009 5/2001

* cited by examiner

*Primary Examiner*—Lamson Nguyen
(74) *Attorney, Agent, or Firm*—Robert J. Depke; Trexler, Bushnell, Giangiorgi, Blackstone & Marr, Ltd.

(57) ABSTRACT

A printer head chip includes a plurality of ink compressing chambers which include heat-generating resistors and which are disposed side by side on a substrate. The printer head chip is used to discharge ink inside the plurality of ink compressing chambers from a nozzle by driving the heat-generating resistors. The printer head chip further includes an ink flow path groove, which is formed in the substrate and which is connected to each of the ink compressing chambers, for supplying ink to each of the ink compressing chambers. The invention makes it possible to supply ink to the printer head chip without increasing the size of a printer head, and to simplify the structure of the printer head.

17 Claims, 10 Drawing Sheets

PRINTER HEAD CHIP AND PRINTER HEAD

The subject matter of application Ser. No. 10/236,449 is incorporated herein by reference. The present application is a divisional of U.S. application Ser. No. 10/236,449, filed Sep. 6, 2002, now U.S. Pat. No. 6,874,865, which claims priority to Japanese Patent Application No. JP2001-273032, filed Sep. 10, 2001, and Japanese Patent Application No. JP2001-273040, filed Sep. 10, 2002, The present application claims priority to these previously filed applications.

BACKGROUND OF THE INVENTION

1. Field of the Invention

The present invention relates to a printer head chip suitable for use in, for example, an inkjet printer, and a printer head using the printer head chip.

2. Description of the Related Art

A printer head of a type which discharges ink drops through a nozzle by generating pressure of ink bubbles inside an ink compressing chamber by heating a heat-generating resistor provided inside the ink compressing chamber is conventionally known. FIG. 11 is a sectional view of an example of a related printer head of this type.

In FIG. 11, a printer head chip 1 of the printer head includes a substrate 2, heat-generating resistors (heaters) 3 formed on the substrate 2, ink compressing chambers 4, and nozzles 5 formed at the top portions of the ink compressing chambers 4.

The heat-generating resistors 3 are used to compress ink that fills the inside of the ink compressing chambers 4 by the heat of the heat-generating resistors 3.

Each ink compressing chamber 4 is formed by a film 6 provided on the substrate 2 and a nozzle sheet 7 placed on the top portion of the film 6. The film 6 has a form which allows it to surround the vicinity of each heat-generating resistor 3 and forms a side wall of each ink compressing chamber 4. The nozzle sheet 7 forms the top wall of each ink compressing chamber 4. Further, the nozzles 5 having openings of predetermined diameters are formed in the nozzle sheet 7. Each nozzle 5 is disposed so as to be positioned above its corresponding heat-generating resistor 3.

An ink flow path 8 which connects to each ink compressing chamber 4 is formed in the printer head. In the example shown in FIG. 11, the ink flow path 8 is formed at both the left and right sides and the bottom side of the printer head chip 1. The ink flow path 8 is used to send ink into the ink compressing chambers 4, and is connected to ink supplying means (not shown).

In the printer head chip 1 having the above-described structure, ink is sent into the ink compressing chambers 4 through the ink flow path 8 from the ink supplying means. The ink sent into the ink compressing chambers 4 is heated by the heat-generating resistors 3. By pressure generated by this heating, the ink inside the ink compressing chambers 4 becomes ink bubbles. By expansion of the ink bubbles, ink drops i are discharged from the corresponding nozzles 5 and land onto a print medium such as paper.

However, in the above-described related technology, in order to supply ink to the ink compressing chambers 4 from the ink supplying means, it is necessary to form the ink flow path 8 over the length of the printer head chip 1 independently of the printer head chip 1, externally of the printer head chip 1. In other words, in order to supply ink into the ink compressing chambers 4, as shown in FIG. 11, it is necessary to provide the ink flow path 8 so that it is wider than the cross-sectional width of the printer head chip 1 and extends over the longitudinal direction of the printer head chip 1.

Therefore, this type of printer head has problems in that its overall size becomes large and in that its structure becomes complicated due to the formation of the ink flow path 8.

Here, as regards a relatively small printer head like that used in a serial printer, the size is not a very serious problem, but as regards, in particular, a long printer head like that used in a line printer, there is a problem in that the ink flow path 8 becomes large due to the long printer head.

In the above-described related technology, since the printer head chip 1 and the ink inside the ink flow path 8 are in contact with each other, a cooling effect of the printer head chip 1 by the ink can be expected. However, since the ink merely stays inside the ink flow path 8, there is a problem that a sufficient cooling effect cannot be provided.

On the other hand, when ink near the ink compressing chambers 4 contains bubbles, it is necessary to remove them. This is because, when the bubbles break when the ink is compressed, sufficient force is no longer exerted upon ink drops i in the direction in which they are discharged, so that the ink drops i tend to be improperly discharged.

When ink near the ink compressing chambers 4 contains bubbles, however, the bubbles can only be removed by suctioning them from the outside. Therefore, there is a problem in that ink is wastefully consumed.

SUMMARY OF THE INVENTION

Accordingly, in view of such circumstances, it is an object of the present invention to make it possible to supply ink to a printer head chip without increasing the size of a printer head and to simplify the structure of the printer head.

It is also an object of the present invention to make it possible to achieve a sufficient cooling effect using ink and not to waste ink when removing bubbles.

To these ends, according to a first aspect of the present invention, there is provided a printer head chip comprising a plurality of ink compressing chambers which include heat-generating resistors and which are disposed side by side on a substrate. The printer head chip is used to discharge ink inside the plurality of ink compressing chambers from a nozzle by driving the heat-generating resistors. The printer head chip includes an ink flow path groove, which is formed in the substrate and which is connected to each of the ink compressing chambers, for supplying ink to each of the ink compressing chambers.

According to a second aspect of the present invention, there is provided a printer head comprising a plurality of printer head chips each comprising a plurality of ink compressing chambers which include heat-generating resistors and which are disposed side by side on a substrate. Each of the plurality of printer head chips includes an ink flow path groove which is provided in the substrate, which connects to each of the corresponding ink compressing chambers, and which is used to supply ink to each of the corresponding ink compressing chambers. The plurality of printer head chips are used to discharge the ink inside the plurality of ink compressing chambers from corresponding nozzles by driving the heat-generating resistors. The printer head also comprises one nozzle sheet having the plurality of printer head chips disposed thereat and having the nozzles formed at locations corresponding to locations of the heat-generating resistors. The ink flow path grooves of the plurality of printer head chips are connected together.

According to a third aspect of the present invention, there is provided a printer head comprising a plurality of printer head chips each comprising a plurality of ink compressing chambers which include heat-generating resistors and which are disposed side by side on a substrate. Each of the plurality of printer head chips includes an ink flow path groove which is provided in the substrate, which connects to each of the corresponding ink compressing chambers, and which is used to supply ink to each of the corresponding ink compressing chambers. The plurality of printer head chips are used to discharge the ink inside the plurality of ink compressing chambers from corresponding nozzles by driving the heat-generating resistors. The printer head further comprises one nozzle sheet having the plurality of printer head chips disposed thereat and having the nozzles formed at locations corresponding to locations of the heat-generating resistors, first ink supplying means for supplying ink to the ink flow path groove of one printer head chip, and second ink supplying means for supplying ink of a color which is different from a color of the ink supplied from the first ink supplying means to the ink flow path groove of another printer head chip.

According to a fourth aspect of the present invention, there is provided a printer head comprising a plurality of printer head chips each comprising a plurality of ink compressing chambers which include heat-generating resistors and which are disposed side by side on a substrate. Each of the plurality of printer head chips includes an ink flow path groove which is provided in the substrate, which connects to each of the corresponding ink compressing chambers, and which is used to supply ink to each of the corresponding ink compressing chambers. The plurality of printer head chips are used to discharge the ink inside the plurality of ink compressing chambers from corresponding nozzles by driving the heat-generating resistors. In addition, the printer head further comprises one nozzle sheet having the plurality of printer head chips disposed thereat with the ink flow path grooves being connected, and having the nozzles formed at locations corresponding to locations of the heat-generating resistors. The plurality of printer head chips form a first printer head chip group and a second printer head chip group disposed at the nozzle sheet. The first printer head chip group includes printer head chips that are disposed in a line in a longitudinal direction thereof, and the second printer head chip group is disposed beside the first printer head chip group. Further, the printer head comprises first ink supplying means for supplying ink to the ink flow path groove of each of the printer head chips of the first printer head chip group and second ink supplying means for supplying ink of a color which is different from a color of the ink supplied from the first ink supplying means to the ink flow path groove of each of the printer head chips of the second printer head chip group.

According to a fifth aspect of the present invention, there is provided a printer head chip comprising a plurality of ink compressing chambers which include heat-generating resistors and which are disposed side by side on a substrate. The printer head chip is used to discharge ink inside the plurality of ink compressing chambers from a nozzle by driving the heat-generating resistors. The printer head chip includes an ink flow path groove, which is formed in the substrate and which connects to each of the ink compressing chambers, for supplying ink to each of the ink compressing chambers; a first ink flow path hole, formed so as to connect the ink flow path groove and the outside of the substrate, for sending ink to the ink flow path groove; and a second ink flow path hole, formed so as to connect the ink flow path groove and the outside of the substrate, for sending the ink inside the ink flow path groove to the outside.

According to a sixth aspect of the present invention, there is provided a printer head comprising a printer head chip comprising a plurality of ink compressing chambers which include heat-generating resistors and which are disposed side by side on a substrate. The printer head chip includes an ink flow path groove which is provided in the substrate, which connects to each of the ink compressing chambers, and which is used to supply ink to each of the ink compressing chambers; a first ink flow path hole which is formed so as to connect the ink flow path groove and the outside of the substrate and which is used to send ink to the ink flow path groove; and a second ink flow path hole which is formed so as to connect the ink flow path groove and the outside of the substrate and which is used to send the ink inside the ink flow path groove to the outside. The printer head chip is used to discharge the ink inside the plurality of ink compressing chambers from a nozzle by driving the heat-generating resistors. The printer head also comprises ink supplying means, connected to the first and second ink flow path holes of the printer head chip, for sending ink to the first ink flow path hole and for recovering ink from the second ink flow path hole.

According to a seventh aspect of the present invention, there is provided a printer head comprising a printer head chip group including printer head chips each comprising ink compressing chambers which include heat-generating resistors and which are disposed side by side on a substrate. Each of the printer head chips is used to discharge ink inside the plurality of ink compressing chambers from a nozzle by driving the heat-generating resistors. Each of the printer head chips includes an ink flow path groove which is formed in the substrate, which connects to each of the corresponding ink compressing chambers, and which is used to supply ink to each of the corresponding ink compressing chambers. The printer head chips are disposed in a line, and the ink flow path grooves of the printer head chips are connected to each other. The printer head includes a first ink flow path hole, formed so as to connect the outside of the substrate and the ink flow path groove of the printer head chip disposed at one end of the printer head chip group, for sending ink to the ink flow path groove; a second ink flow path hole, formed so as to connect the outside of the substrate and the ink flow path groove of the printer head chip disposed at the other end of the printer head chip group, for sending the ink inside the ink flow path groove to the outside; and ink supplying means, connected to the first and second ink flow path holes of the corresponding printer head chips, for sending ink to the first ink flow path hole and for recovering ink from the second ink flow path hole.

In the first aspect of the invention, when ink is supplied to the ink flow path groove formed in the substrate, the ink is sent to each ink compressing chamber connected to the ink flow path groove. By this, each ink compressing chamber is filled with the ink.

Therefore, by forming the ink flow path groove in the printer head chip, it is possible to supply ink by the printer head chip alone. Consequently, it is not necessary to form an ink flow path over the length of the printer head chip independently of the printer head chip, externally of the printer head chip. By this, it is possible to reduce the size of the printer head.

In the second aspect of the invention, one nozzle sheet having nozzles formed in correspondence with the heat-generating resistors of the plurality of printer head chips is provided. The ink flow path grooves of the corresponding printer head chips are connected, and ink is supplied to the printer head chips through the corresponding ink flow path grooves.

Therefore, it is possible to simplify the structure of the printer head. By this, it is possible to make the printer head highly reliable.

In the third aspect of the invention, one nozzle sheet having nozzles formed in correspondence with the heat-generating resistors of the plurality of printer head chips is provided. In addition, when ink is supplied from the first ink supplying means to the ink flow path groove of one printer head chip and ink is supplied from the second ink supplying means to the ink flow path groove of another printer head chip, a color printer head is formed.

Therefore, it is possible to simplify the structure of the color printer head, and to supply ink using a simple structure.

In the fourth aspect of the invention, one nozzle sheet having nozzles formed in correspondence with the heat-generating resistors of the plurality of printer head chips is provided. In addition, a first printer head chip group and a second printer head chip group in which a plurality of printer head chips are disposed in a line in the longitudinal direction are formed, with the ink flow path grooves of the corresponding printer head chips of each printer head chip group being connected. When ink is supplied from the first ink supplying means to the ink flow path of each printer head chip of the first printer head chip group and ink is supplied from the second ink supplying means to the ink flow path groove of each printer head chip of the second printer head chip group, a color line printer head is formed.

Therefore, it is possible to supply ink to all of the printer head chips with each printer head chip group. In addition, it is possible to simplify the structure of the color line printer head, and to supply ink using a simple structure.

In the fifth aspect of the invention, when ink is supplied to the ink flow path groove formed in the substrate, the ink is sent to each ink compressing chamber connected to the ink flow path groove. By this, each ink compressing chamber is filled with ink.

Accordingly, by forming the ink flow path groove in the printer head chip, the printer head chip can supply ink by itself. Consequently, it is not necessary to form an ink flow path over the length of the printer head chip independently of the printer head chip, externally of the printer head chip. By this, it is possible to reduce the size of the printer head.

In addition, when the printer head chip is used in the printer head, ink is sent into the ink flow path groove from the first ink flow path hole, and the ink inside the ink flow path groove is sent out from the second ink flow path hole.

Therefore, it is possible to circulate the ink inside the printer head chip.

The sixth aspect of the invention provides the same operations and advantages as those of the fifth aspect of the invention. In addition, in the sixth aspect, the ink supplying means sends ink to the printer head chip from the first ink flow path hole, and recovers the ink inside the printer head chip.

Accordingly, the ink inside the printer head chip can be circulated by the ink supplying means. Accordingly, using the ink supplying means, it is possible to dissipate heat generated by the printer head chip.

In the seventh aspect of the invention, the ink supplying means sends ink from the first ink flow path hole to the printer head chip at one end of the printer head chip group. Since the ink flow path grooves are connected in the printer head chips of the printer head chip group, the ink is sent to all of the printer head chips.

The ink sent to the printer head chip group is recovered by the ink supplying means from the second ink flow path hole of the printer head chip at the other end of the printer head chip group.

Therefore, the ink inside the printer head chip group can be circulated by the supplying means. By this, using the ink supplying means, it is possible to dissipate heat generated by the printer head chips.

DESCRIPTION OF THE PREFERRED EMBODIMENTS

Figure 1:
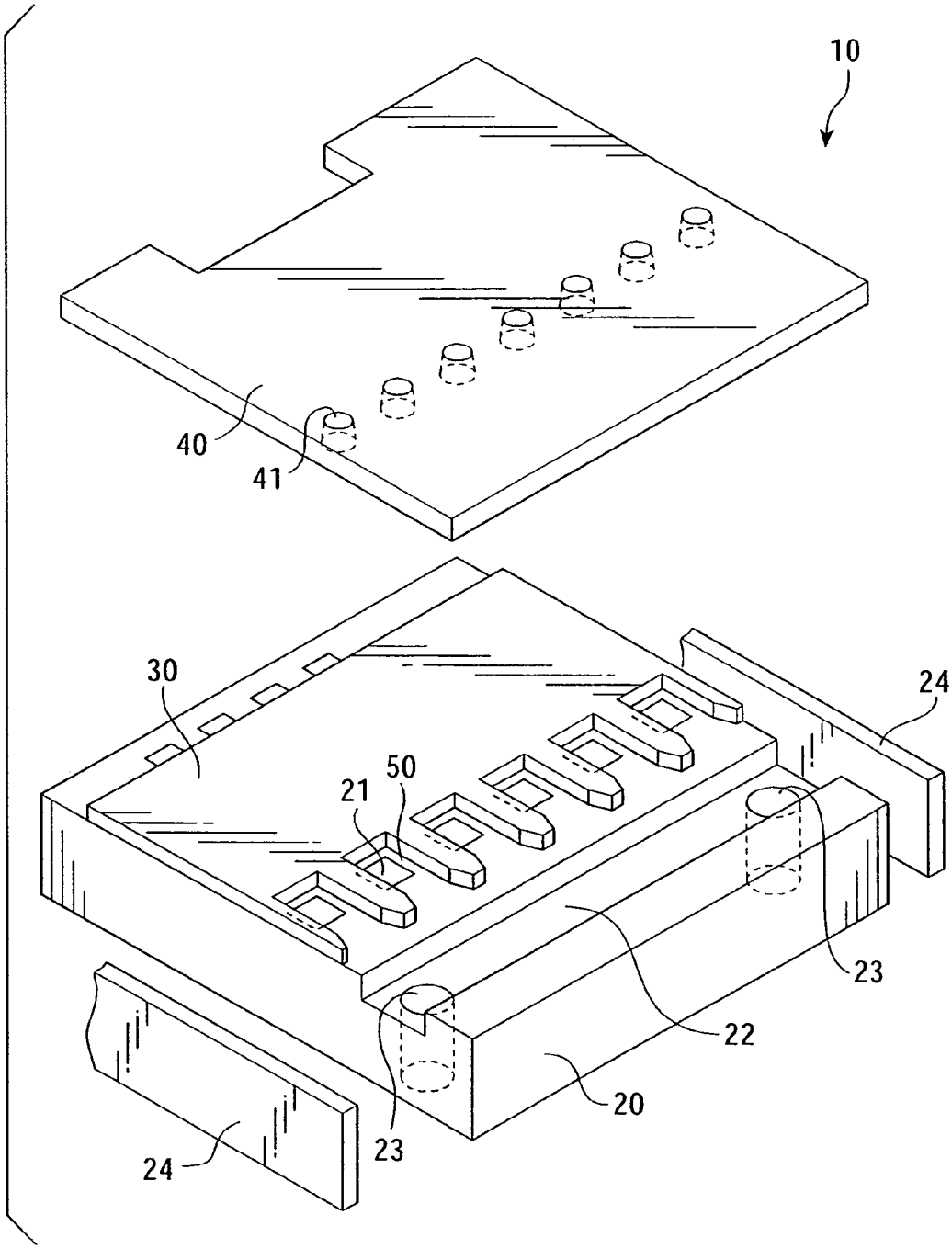
FIG. 1 is an exploded perspective view of a first embodiment of a printer head chip of the present invention.

Hereunder, a first embodiment of the present invention will be described with reference to the drawings. The first embodiment corresponds to the first to fourth aspects of the application. FIG. 1 is an exploded perspective view of a first embodiment of a printer head chip of the present invention. A printer head chip 10 is used in a printer head for a thermal inkjet printer.

The printer head chip 10 comprises a substrate 20, a film 30, and a nozzle sheet 40.

The substrate 20 is a semiconductor substrate formed of, for example, silicon. Heat-generating resistors (heaters) 21 are formed on one surface (the top surface in FIG. 1) of the substrate 20. The heat-generating resistors 21 are used to heat ink to be discharged.

Controlling of driving and the like of the heat-generating resistors 21 are carried out by the substrate 20. Although not shown, a logic integrated circuit (IC), a driver transistor, etc., are provided on the substrate 20.

The film 30 is placed upon the top surface (in FIG. 1) of the substrate 20. The film 30 is formed of, for example, an exposure-hardening-type dry film resist. After the film 30 has been placed on substantially the entire surface of the substrate 20 where the heat-generating resistors 21 are formed, unnecessary portions of the film 30 are removed by a photolithography process in order to form the film 30 with a predetermined shape.

By this, the film 30 is formed with a substantially comb-tooth shape so as to surround the vicinity of each of the heat-generating resistors 21 (so that substantially concave portions of the film 30 surround the heat-generating resistors 21 as viewed from above the film 30). The portions surrounding the heat-generating resistors 21 define ink compressing chambers 50. Therefore, the film 30 forms side walls of the ink compressing chambers 50.

The nozzle sheet 40 is a sheet-shaped member having nozzles 41 for discharging ink formed therein, and has a thickness of, for example, tens of micrometers (μm). The nozzles 41 are circular holes having diameters of the order of, for example, from 10 μm to tens of μm.

Each nozzle 41 is formed so as to be disposed above its corresponding heat-generating resistor 21 when the nozzle sheet 40 is placed upon the top surface of the sheet 30 in FIG. 1. In addition, the nozzle sheet 40 forms the top wall of each ink compressing chamber 50.

In the substrate 20, an ink flow path groove 22 is formed near an end surface of the substrate 20 adjacent to an open-side (forward right side in FIG. 1) of each ink compressing chamber 50. The ink flow path groove 22 is connected to each ink compressing chamber 50, and is used to supply ink to each ink compressing chamber 50. The ink flow path groove 22 has a substantially concave shape in cross section, and, in the embodiment, is formed in a straight line along an end surface of the substrate 20. The ink flow path groove 22 may be formed by various methods, such as dicing or etching.

Ink flow path holes 23 which pass through the substrate 20 to the bottom surface thereof in FIG. 1 are formed in both longitudinal direction side end portions of the ink flow path groove 22. The ink flow path holes 23 connect the ink flow path groove 22 and the outside of the substrate 20, and are used to send ink from outside the substrate 20 to the ink flow path groove 22. The ink flow path holes 23 may be formed by various methods such as mechanical processing, ultrasonic processing, laser processing, or wet etching.

Plate-shaped blocking members 24 are mounted to both side surfaces of the substrate 20 by bonding or the like so as to block both ends of the ink flow path groove 22 of the substrate 20. The blocking members 24 are used to prevent ink flowing in the ink flow path groove 22 from leaking to the outside of the substrate 20.

Although FIG. 1 shows an example in which six heat-generating resistors 21 and six ink compressing chambers 50 and nozzles 41 corresponding to the heat-generating chambers 50 are provided side by side, there are actually hundreds of them at one substrate 20.

Figure 2:
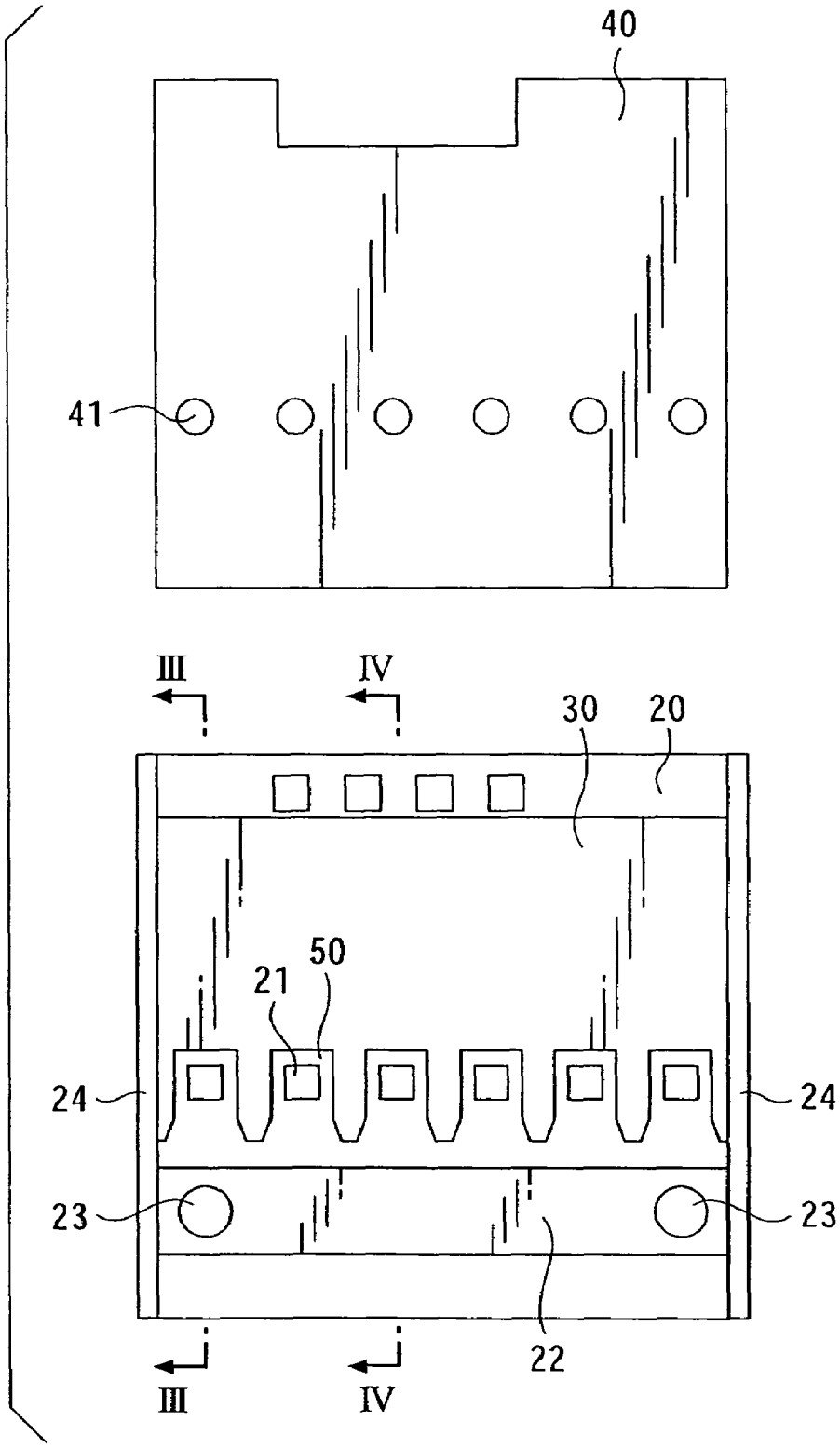
FIG. 2 is an exploded plan view of a substrate side and a nozzle sheet shown in the exploded perspective view of FIG. 1.
Figure 3:
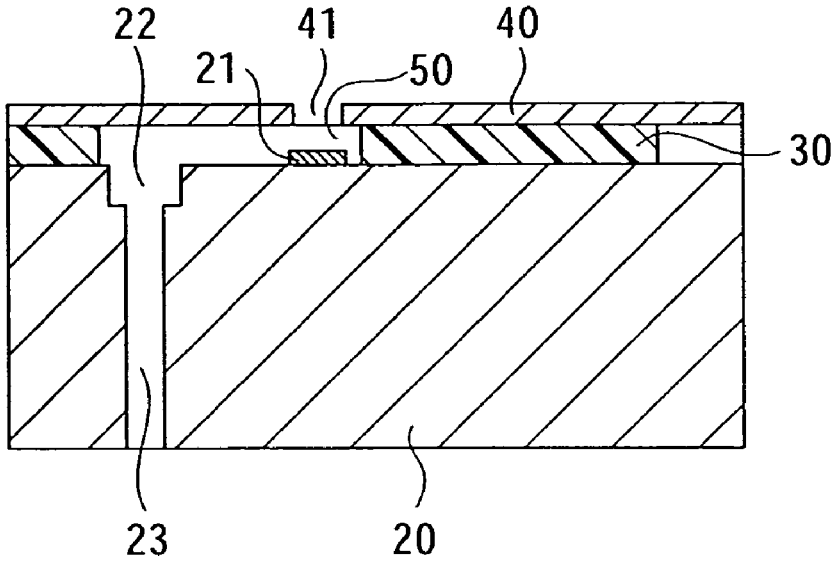
FIG. 3 is a sectional view taken along line III—III of FIG. 2, with the nozzle sheet also being shown.
Figure 4:
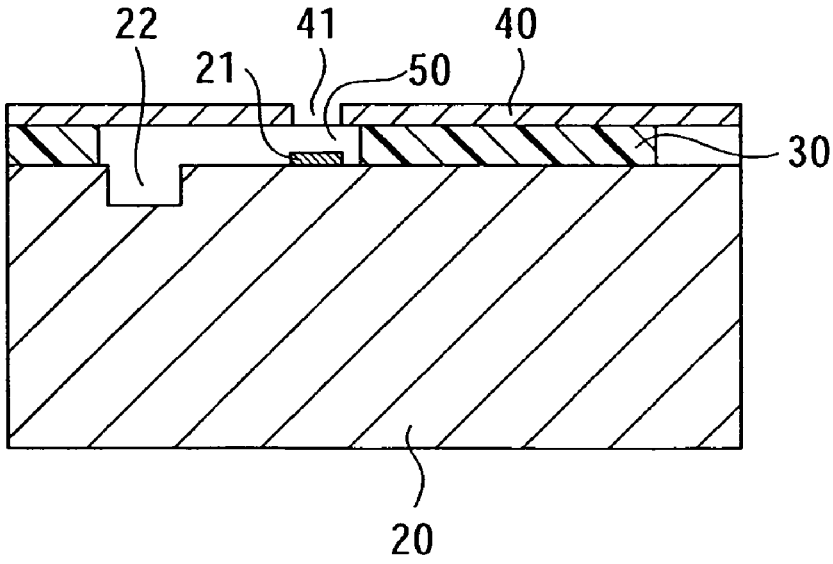
FIG. 4 is a sectional view taken along line IV—IV of FIG. 2, with the nozzle sheet also being shown.

Next, the ink flow path groove 22 and the ink flow path holes 23 will be described in more detail. FIG. 2 is an exploded plan view of the substrate-20 side and the nozzle sheet 40 shown in the exploded perspective view of FIG. 1. FIG. 3 is a sectional view taken along line III—III of FIG. 2, with the nozzle sheet 40 also being shown. FIG. 4 is a sectional view taken along line IV—IV of FIG. 2, with the nozzle sheet 40 also being shown.

As shown in FIG. 3, the ink flow path holes 23 are formed so that their inside diameters are slightly smaller than the lateral width of the bottom surface defining the ink flow path groove 22.

As shown in FIG. 4, only the ink flow path groove 22 is formed in the portion where the ink flow path holes 23 are not formed.

Figure 5:
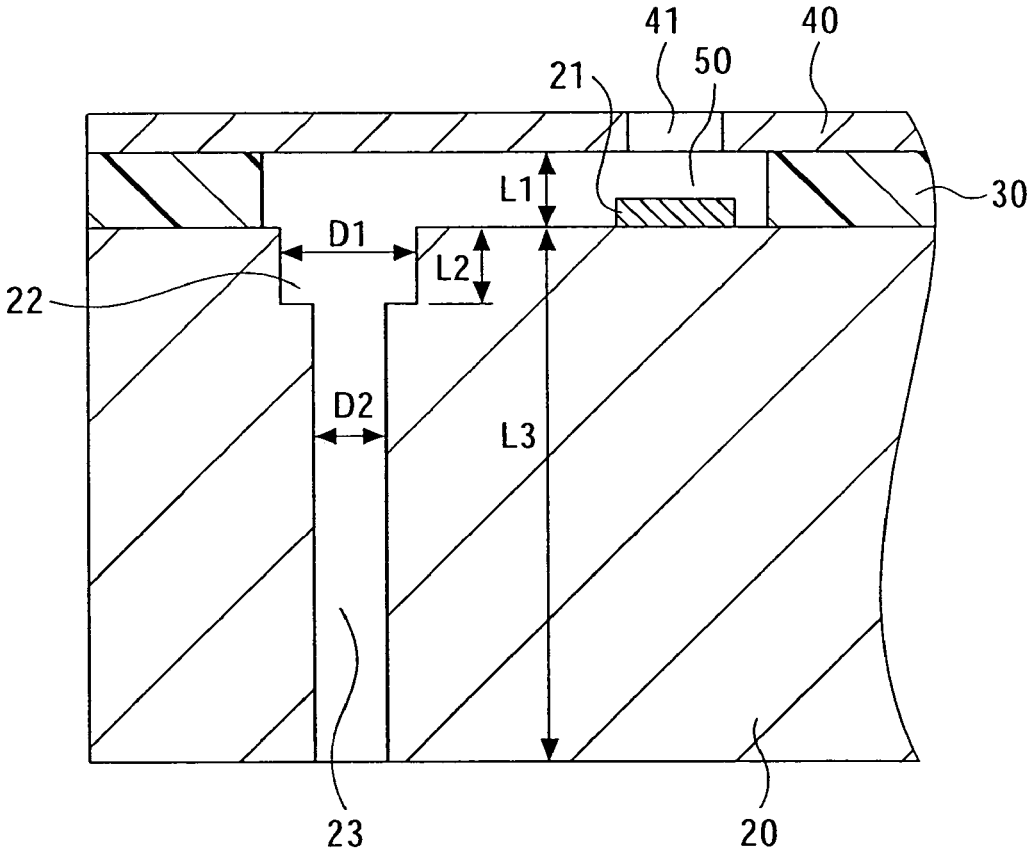
FIG. 5 is a sectional view showing in enlarged form an ink flow path groove, an ink flow path hole, etc., shown in FIG. 3.

FIG. 5 is a sectional view showing in enlarged form the ink flow path groove 22, the ink flow path hole 23, etc., shown in FIG. 3.

In FIG. 5, L1 represents the length from the top surface of the substrate 20 to the bottom surface of the nozzle sheet 40, that is, the height of the ink compressing chamber 50. L1 is of the order of approximately 10 to 15 μm. L3 represents the thickness of the substrate 20, and is of the order of approximately 1 mm.

D1 represents the width of the ink flow path groove 22, and is of the order of approximately 2 to 5 mm. L2 represents the depth of the ink flow path groove 22, and is of the order of approximately 300 to 700 μm. D2 represents the inside diameter of the ink flow path hole 23, and is approximately equal to 1.5 to 4.5 mm (D1≧D2).

The aforementioned values are examples of suitable values when the rate of discharge of ink drops from one printer head chip 10 is 0.01 cc/sec. Therefore, L1 to L3, and D1 and D2 differ depending on ink property, ink drop discharge conditions, etc., so that they are not limited to the aforementioned values.

The printer head chip 10 having the above-described structure is used as a serial printer head or a line printer head. It is also used as a color printer head in addition to a monochromatic printer head.

For example, when the serial printer head includes the printer head chip 10 shown in FIG. 1, only one ink flow path hole 23 of the printer head chip 10 is provided.

Ink supplying means (not shown) including an ink tank and the ink flow path hole 23 of the printer head chip 10 are connected together. By this, ink supplied from the ink supplying means flows into the ink flow path groove 22 from the ink flow path hole 23 and fills all of the ink compressing chambers 50.

By causing an electrical current pulse with a short time period (for example, of the order of one to three microseconds) to flow to a selected heat-generating resistor 21 by a command from a printer control section (not shown), the heat-generating resistor 21 is quickly heated. As a result, air bubbles (in a gas phase) are produced in an ink portion that contacts the heat-generating resistor. By expansion of the bubbles in the ink, ink of a certain volume is pushed away. By this, ink which has a volume equal to that of an ink portion contacting the corresponding nozzle 41 that has been pushed away is discharged from the corresponding nozzle 41 as ink drops, and lands onto a print material such as paper.

When the ink drops are discharged, the inside of the ink compressing chamber 50 from which the ink drops have been discharged is immediately replenished with an amount of ink equal the amount of ink that has been discharged. The replenishing ink is supplied from the ink supplying means through the ink flow path groove 22 and the ink flow path holes 23.

Figure 6:
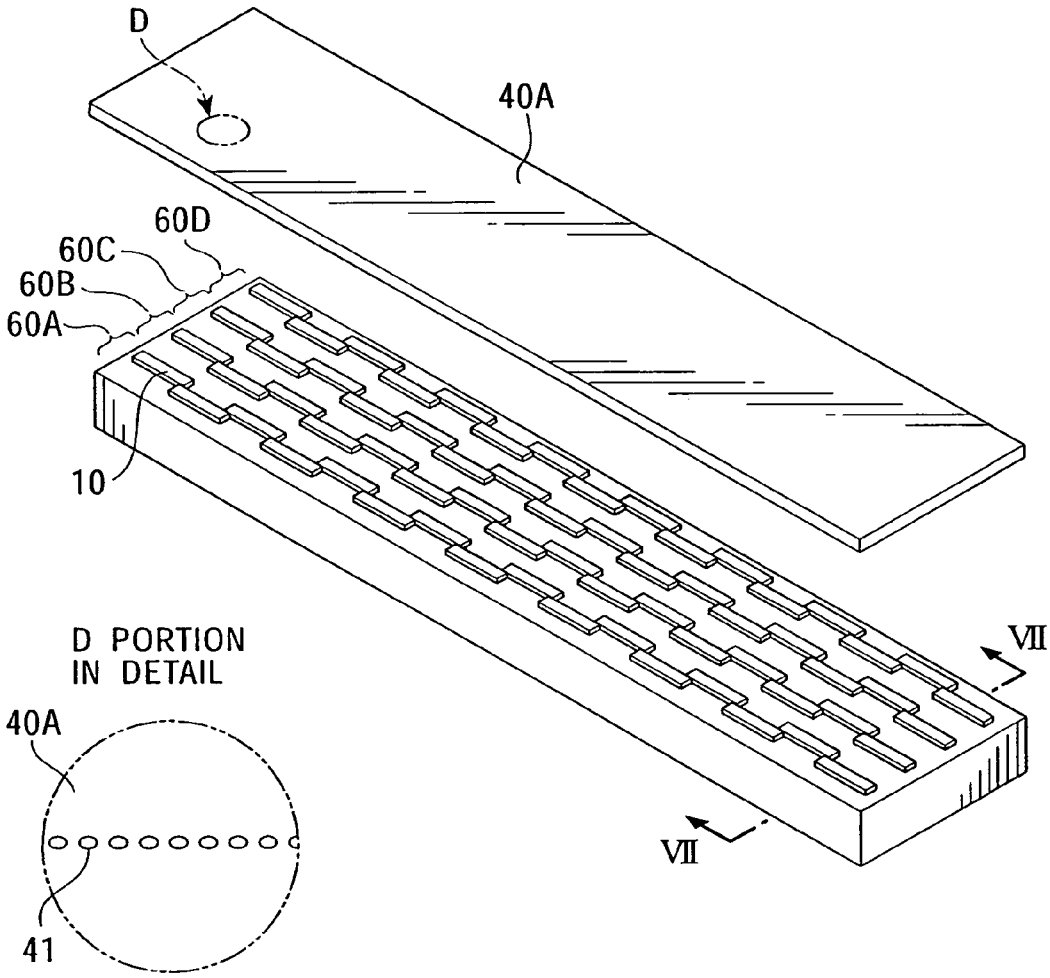
FIG. 6 is an external exploded perspective view of a color line printer head which uses a plurality of the printer head chips, with a detail of a D portion also being shown.

FIG. 6 is an external exploded perspective view of a color line printer head which uses a plurality of the printer head chips 10. In FIG. 6, a D portion is shown along with a detailed illustration of the D portion.

In FIG. 6, the printer head comprises a first printer head chip group 60A, a second printer head chip group 60B, a third printer head chip group 60C, and a fourth printer head chip group 60D. The printer head chip groups 60A to 60D are disposed in four rows in accordance with four colors.

The first printer head chip group 60A, the second printer head chip group 60B, the third printer head chip group 60C, and the fourth printer head chip group 60D are used to discharge ink of different colors, more specifically, yellow (Y) ink, magenta (M) ink, cyan (C) ink, and black (B) ink, respectively.

In addition, each printer head chip 10 of each of the printer head chip groups 60A to 60D is disposed in a line in the longitudinal direction. Adjacent printer head chips 10 of each of the printer head chip groups 60A to 60D are disposed so that portions of the adjacent printer head chips 10 overlap each other. More specifically, in a direction orthogonal to the longitudinal direction of each printer head chip 10, every other printer head chip 10 is disposed in substantially corresponding locations, and adjacent printer head chips 10 are disposed so that they are positionally displaced from each other.

The printer head chips 10 are disposed in this way so that, even if there are differences in printing qualities (for example, discharging properties of ink drops) between the printer head chips 10, differences in printing qualities between adjacent printer head chips 10 are not noticeable. In addition, by providing a plurality of printer head chips 10 with respect to one nozzle sheet 40A, it is possible to increase the precision with which nozzles 41 are positioned.

Here, the nozzle sheet 40A has its nozzles 41 formed in locations corresponding to the locations of the heat-generating resistors 21 of each of the printer head chips 10 of each of the corresponding printer head chip groups 60A to 60D, and is formed of one sheet material. As shown in the detailed illustration of the D portion in FIG. 6, the nozzles 41 are formed in the nozzle sheet 40A at locations corresponding to the locations of the heat-generating resistors 21 of all of the printer head chips 10.

Accordingly, even in the case where a plurality of printer head chips 10 are brought together to form a color line printer head, the nozzle sheet 40A is formed of one sheet material.

Figure 7:
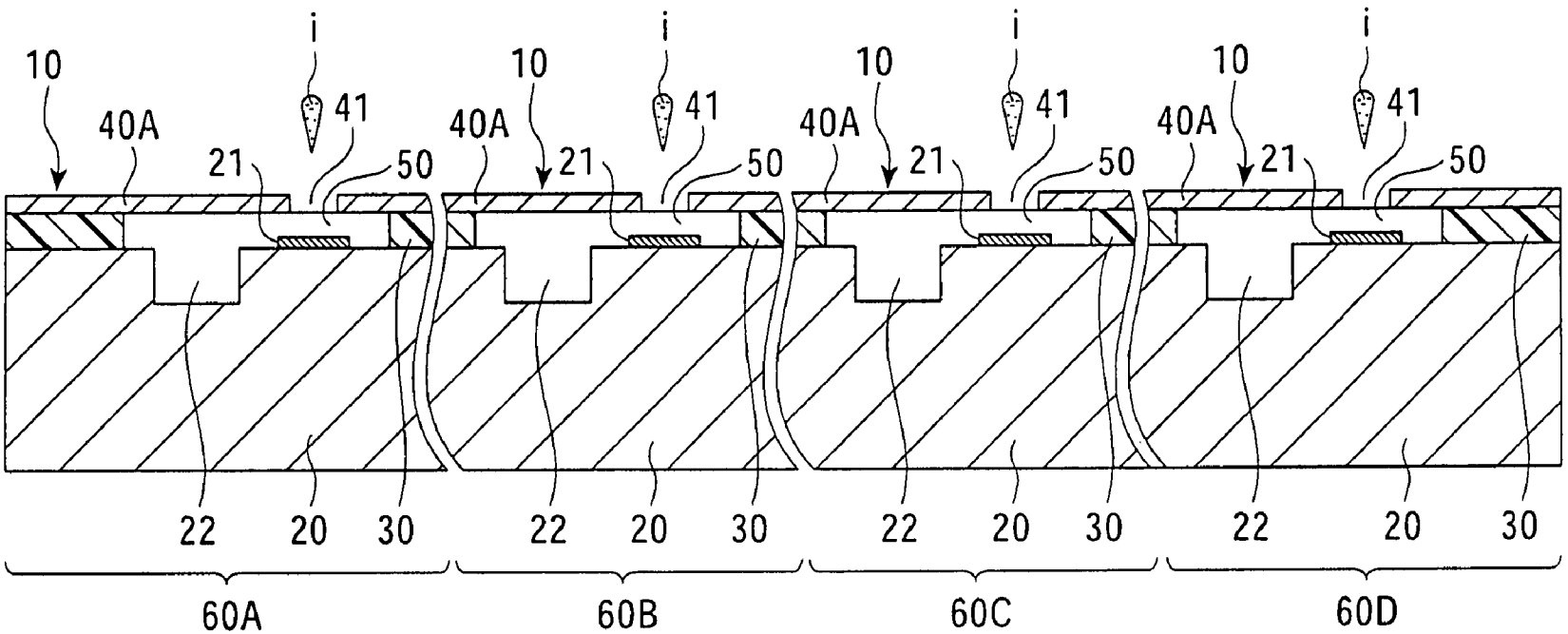
FIG. 7 is a sectional view taken along line VII—VII of FIG. 6, with nozzle sheets also being shown.

FIG. 7 is a sectional view taken along line VII—VII of FIG. 6, with the nozzle sheet also being shown.

Each printer head chip 10 of the first printer head chip group 60A, the second printer head chip group 60B, the third printer head chip group 60C, and the fourth printer head chip group D has the same structure as the above-described printer head chip 10.

Yellow (Y) ink is supplied to the ink flow path groove 22 of each printer head chip 10 of the first printer head chip group 60A. Similarly, magenta (M) ink is supplied to the ink flow path groove 22 of each printer head chip 10 of the second printer head chip group 60B; cyan (C) ink is supplied to the ink flow path groove 22 of each printer head chip 10 of the third printer head chip group 60C; and black (B) ink is supplied to the ink flow path groove 22 of each printer head chip 10 of the fourth printer head chip group 60D.

The heat-generating resistor 21 of each printer head chip 10 is heated in order to compress ink inside its corresponding ink compressing chamber 50, so that ink drops i are discharged from its corresponding nozzle 41.

Next, a description of a method of supplying ink to each printer head chip in the above-described color line printer head will be given.

Figure 8:
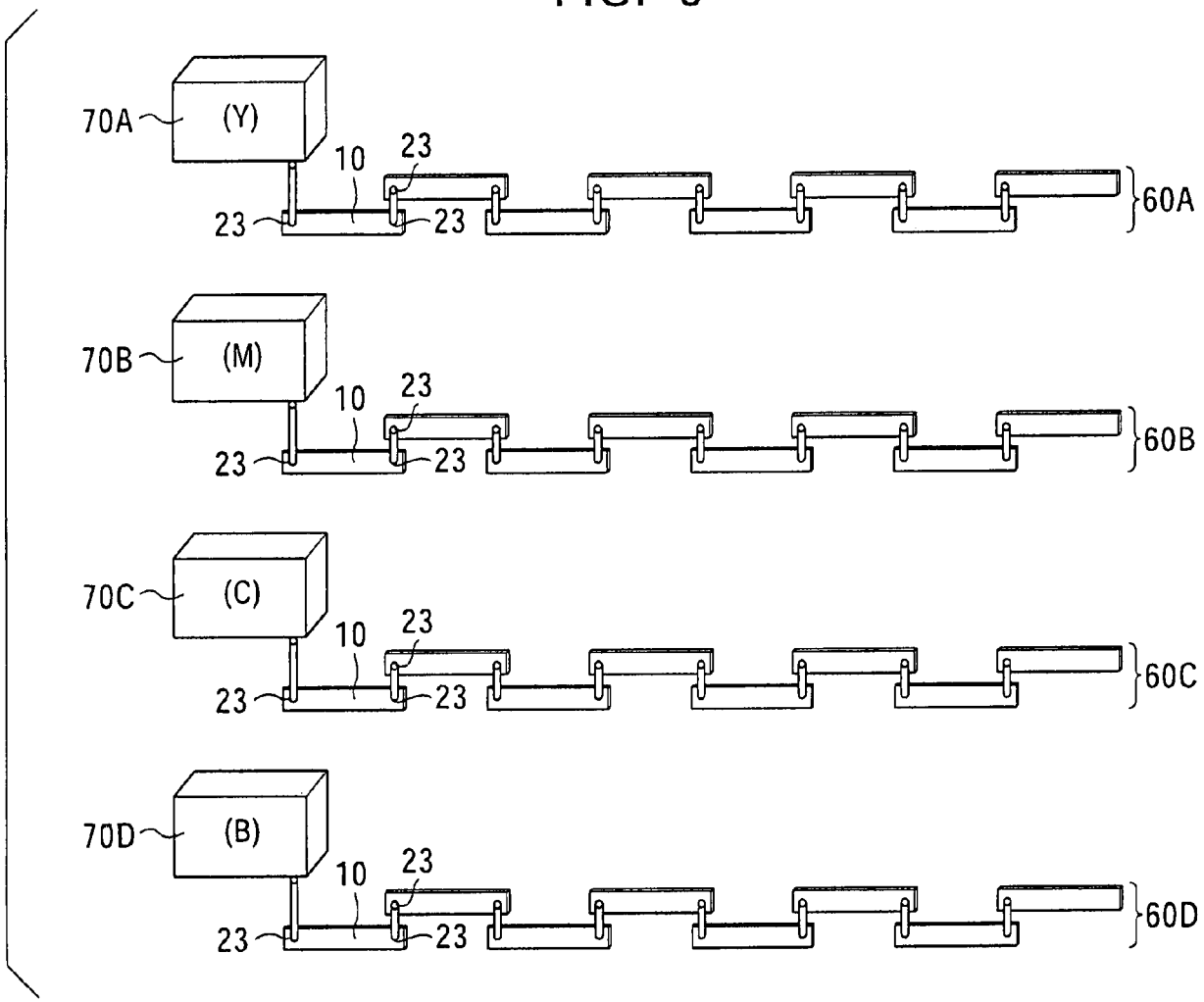
FIG. 8 illustrates a method of supplying ink to each printer head chip of the color line printer head.

FIG. 8 illustrates a method of supplying ink to each printer head chip of the above-described color line printer head.

As shown in FIG. 8, first ink supplying means 70A, second ink supplying means 70B, third ink supplying means 70C, and fourth ink supplying means 70D are independently provided at the printer head chip groups 60A to 60D, respectively. Each of the ink supplying means 70A to 70D comprises an ink tank.

The first ink supplying means 70A, the second ink supplying means 70B, the third ink supplying means 70C, and the fourth ink supplying means 70D are filled with yellow (Y) ink, magenta (M) ink, cyan (C) ink, and black (B) ink, respectively.

Each ink supplying means 70A to 70D is connected to an ink flow path hole 23 of one printer head chip 10 in each of the corresponding printer head chip groups 60A to 60D (the printer head chip 10 disposed closest to each of the corresponding ink supplying means 70A to 70D). In addition, in each of the printer head chip groups 60A to 60D, the ink flow path hole 23 at one end of a printer head chip 10 and the ink flow path hole 23 at the other end of an adjacent printer head chip 10 are connected together.

By this, ink supplied from the ink supplying means 70A to 70D is supplied to all of the corresponding printer head chips 10 through the ink flow path holes 23 and the ink flow path grooves 22 of the printer head chips 10 of the corresponding printer head chip groups 60A to 60D. In this way, even for the case where a certain number of printer head chips 10 are arranged side by side when forming a line printer head, the ink flow path holes 23 of adjacent printer head chips 10 only need to be connected so as to allow flow of ink.

In each printer head chip 10 positioned farthest from the corresponding one of the ink supplying means 70A to 70D in each of the corresponding printer head chip groups 60A to 60D, an ink flow path hole 23 only needs to be formed at one end thereof, so that it is not necessary to form an ink flow path hole 23 at the other end thereof.

Although, in the example shown in FIG. 8, the ink flow path holes 23 of adjacent printer head chips 10 are connected so as to allow flow of ink, the present invention is not limited thereto. Accordingly, if each of the ink supplying means 70A to 70D and each ink flow path hole 23 of one printer head chip 10 disposed closest to each of the corresponding ink supplying means 70A to 70D are connected, and, as regards the other printer head chips 10, the ink flow path grooves 22 of adjacent printer head chips 10 are connected together, so that the ink flow path holes 23 do not necessarily have to be formed in these other printer head chips.

When a color serial printer head is to be formed, one or a few printer head chips 10 may be provided instead of the printer head chip groups 60A to 60D used in the example shown in FIG. 8. In that case, the ink supplying means 70A to 70D supply ink to the ink flow path groove 22 of one or the few printer head chips 10.

In the case where only one printer head chip 10 is used, only one ink flow path hole 23 for supplying ink from each of the ink supplying means 70A to 70D is formed in the printer head chip 10.

When a monochromatic line printer head is formed, it only needs to comprise black (B) ink supplying means 70D and a fourth printer head chip group 60D connected to the ink supplying means 70D so as to allow ink supply from the ink supplying means 70D, which are used in the example shown in FIG. 8.

When a monochromatic serial printer head is formed, it comprises black (B) ink supplying means 70D and one or a few printer head chips 10 connected to the ink supplying means 70D so as to allow ink supply from the ink supplying means 70D, which are used in the example shown in FIG. 8.

As described above, in the printer head chip 10 and the printer head of the present invention, ink can be supplied by the printer head chip 10 alone. Therefore, it is not necessary to form an ink flow path 8 over the length of the printer head chip 1 independently of the printer head chip 1, externally of the printer head chip 1 as in the related example shown in FIG. 9. Therefore, it is possible to reduce the size of the printer head. In addition, since the structure of the printer head can be simplified, it is possible to make the printer head highly reliable.

Even in the case where a color printer head, having a plurality of printer head chips 10 disposed side by side, for discharging ink of a plurality of colors is formed or the case where a line printer head having a plurality of printer head chips 10 disposed in a line is formed, ink can be very easily supplied. In these cases, since the printer head chips 10 are highly independent, even if defects occur in some of the printer head chips 10, the printer head chips 10 can be singly replaced.

Although the first embodiment of the present invention has been described, the present invention is not limited to the above-described first embodiment, so that various modifications such as those described below are possible.

(1) Although, in the embodiment, ink flow path holes 23 are provided in the ink flow path groove 22, the present invention is not limited thereto. For example, it is possible to provide, for example, an ink tank at one end or both ends of the ink flow path groove 22, and to supply ink from the ink tank to the ink flow path groove 22 in order to further supply ink to each ink compressing chamber 50.

(2) Although, in the embodiment, ink flow path holes 23 are formed in both end portions of the ink flow path groove 22, the present invention is not limited thereto. Only one ink flow path hole 23 may be formed at any location in the ink flow path groove 22. In addition, three or more ink flow path holes 23 may be formed in one ink flow path groove 22.

(3) In the case where two ink flow path holes 23 are formed in the ink flow path groove 22 of one printer head chip 10, one of the ink flow path holes 23 is defined as the ink entrance side, while the other ink flow path hole 23 is defined as the ink exit side. However, the present invention is not limited thereto, so that when a plurality of ink flow paths 23 are formed in one printer head chip 10, all of them may be defined as the entrance side.

(4) Although, in the embodiment, the ink flow path groove 22 is formed parallel to and along one end portion of the substrate 20, the shape of the ink flow path groove 22 in the longitudinal direction is not limited thereto, so that it does not necessarily need to be formed with a linear shape.

Although the cross-sectional shape of the ink flow path groove 22 is a substantially concave shape, it is not limited thereto, so that the ink flow path groove 22 may be formed with various other shapes, such as a substantially V shape or a substantially U shape.

(5) Although, in the embodiment, the ink flow path holes 23 have a linear shape that allows them to pass through the substrate 20 from the bottom end surface defining the ink flow path groove 22 to the back surface of the substrate 20, the shape is not limited thereto, so that, for example, the ink flow path holes 23 may have an L shape which connects a side surface of the substrate 20 and the bottom surface defining the ink flow path groove 22.

(6) Although, in the embodiment, a printer head chip 10 of a face shooter type, that is, of a type in which the nozzles 41 are formed in the top surface as shown in FIG. 1 is taken as an example, the type of printer head chip 10 is not limited thereto. The printer head chip 10 may also be an edge shooter type (in which the nozzles 41 are formed in a side surface of the printer head chip 10). In that case, for example, a sheet having no nozzles 41 is attached to the top surface of the printer head chip 10 instead of the nozzle sheet 40 shown in FIG. 1.

A nozzle sheet 40 having nozzles 41 formed in correspondence with the heat-generating resistors 21 is attached to a side surface of the substrate 20 shown in FIG. 1. By this, a printer head chip of an edge shooter type that discharges ink drops from a side surface of the substrate 20 can be formed.

In the above-described first embodiment, by forming an ink flow path groove in a printer head chip, ink can be supplied by the printer head chip alone. Therefore, it is not necessary to form an ink flow path over the length of the printer head chip independently of the printer head chip, externally of the printer head chip. Therefore, it is possible to reduce the size of the printer head.

Figure 9:
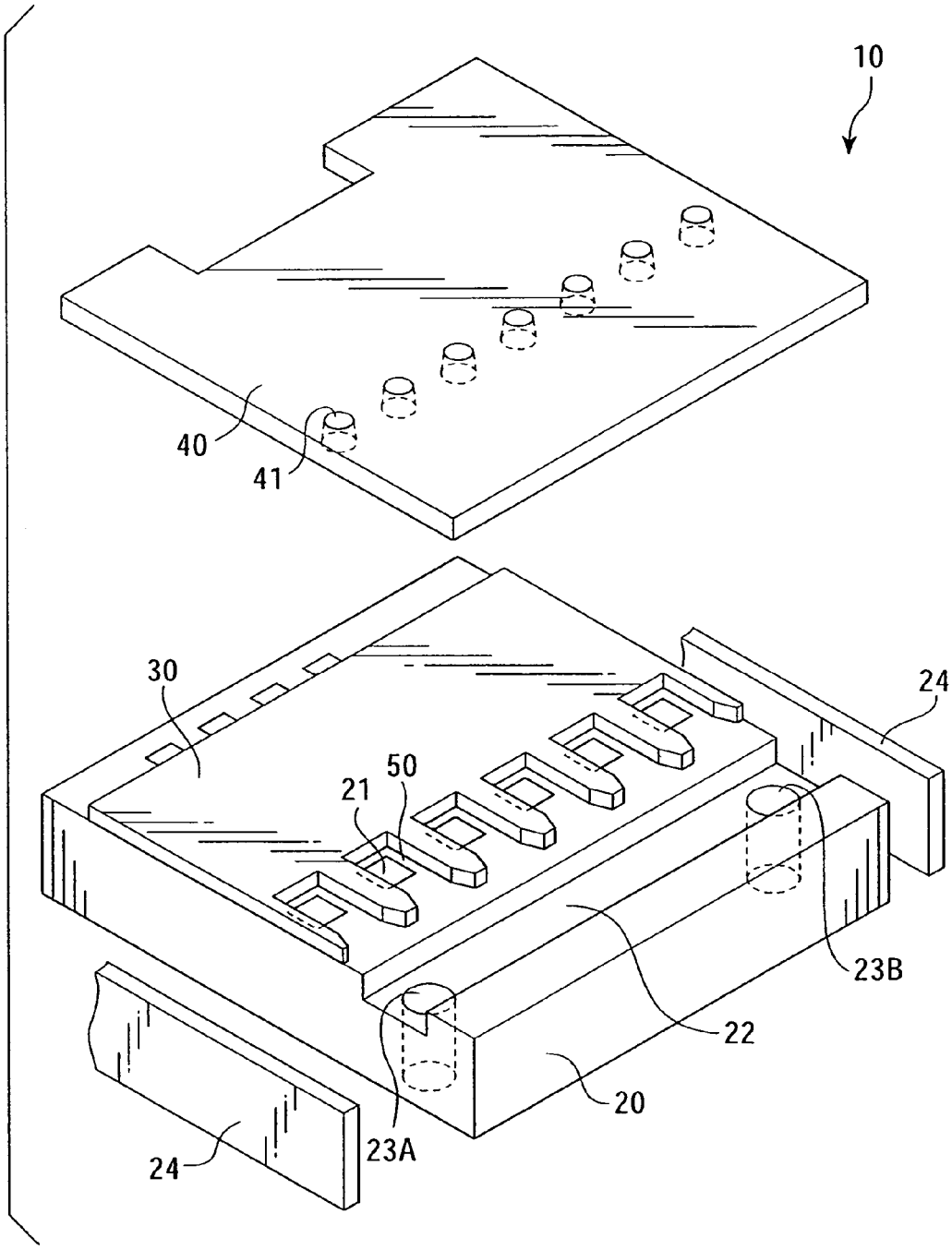
FIG. 9 is an exploded perspective view of a second embodiment of a printer head chip of the present invention.

Next, a description of a second embodiment of the present invention will be given. The second embodiment corresponds to the fifth to seventh aspects of the application. FIG. 9 is an exploded perspective view of the second embodiment of the present invention. A printer head chip 10 is also used in a printer head for a thermal ink-jet printer. Corresponding structural features to those of the first embodiment will not described.

In the second embodiment, as shown in FIG. 9, ink flow path holes 23A and 23B passing through the bottom surface of a substrate 20 in FIG. 9 are formed in both longitudinal direction side end portions of the inside of an ink flow path groove 22. The ink flow path hole 23A (first ink flow path hole) at one end portion is formed so as to connect the ink flow path groove 22 and the outside of the substrate 20, and is used to send ink from outside the substrate 20 to the ink flow path groove 22. The ink flow path hole 23B (second ink flow path hole) at the other end portion is formed so as to connect the ink flow path groove 22 and the outside of the substrate 20, and is used to send ink in the ink flow path groove 22 to the outside of the substrate 20.

As in the first embodiment, the ink flow path holes 23A and 23B may be formed by various methods.

Although, in FIG. 9, the case where six heat-generating resistors 21, and six ink compressing chambers 50 and six nozzles 41 corresponding to the six heat-generating resistors 21 are disposed side by side is given as an example, there are actually a few hundred of these component parts at one substrate 20 as in the first embodiment.

Although not shown, in the second embodiment, the ink flow path hole 23B has the same shape as the ink flow path hole 23A.

In the second embodiment, ink supplying means and the first ink flow path hole 23A and the second ink flow path hole 23B of the printer head chip 10 are connected so that they communicate with each other. By this, ink supplied from the ink supplying means is sent to the ink flow path hole 23A. Therefore, the ink flows into the ink flow path groove 23 and fills the inside of all of the ink compressing chambers 50. The ink supplying means recovers the ink in the ink flow path groove 22 from the ink flow path hole 23B. By this, the ink inside the ink flow path groove 22 of the printer head chip 10 is circulated by the ink supplying means. In order to recover the ink in the ink flow path groove 22 from the ink flow path hole 23B, a suction pump (not shown) or the like is provided.

Next, a description of a method of supplying ink to each printer head chip 10 in a color line printer head will be given.

Figure 10:
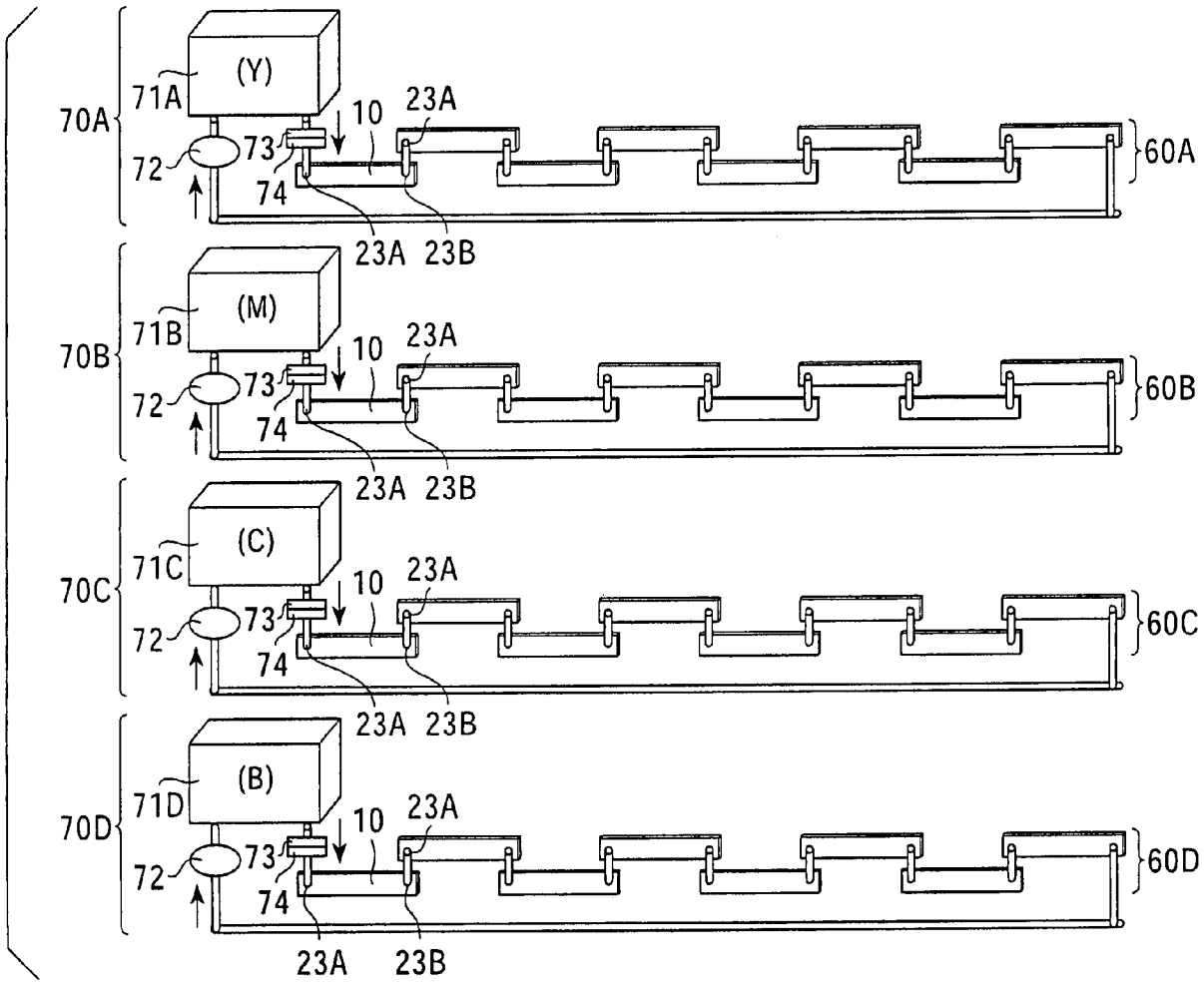
FIG. 10 illustrates a method of supplying ink to each printer head chip of a color line printer head in the second embodiment of the present invention.
Figure 11:
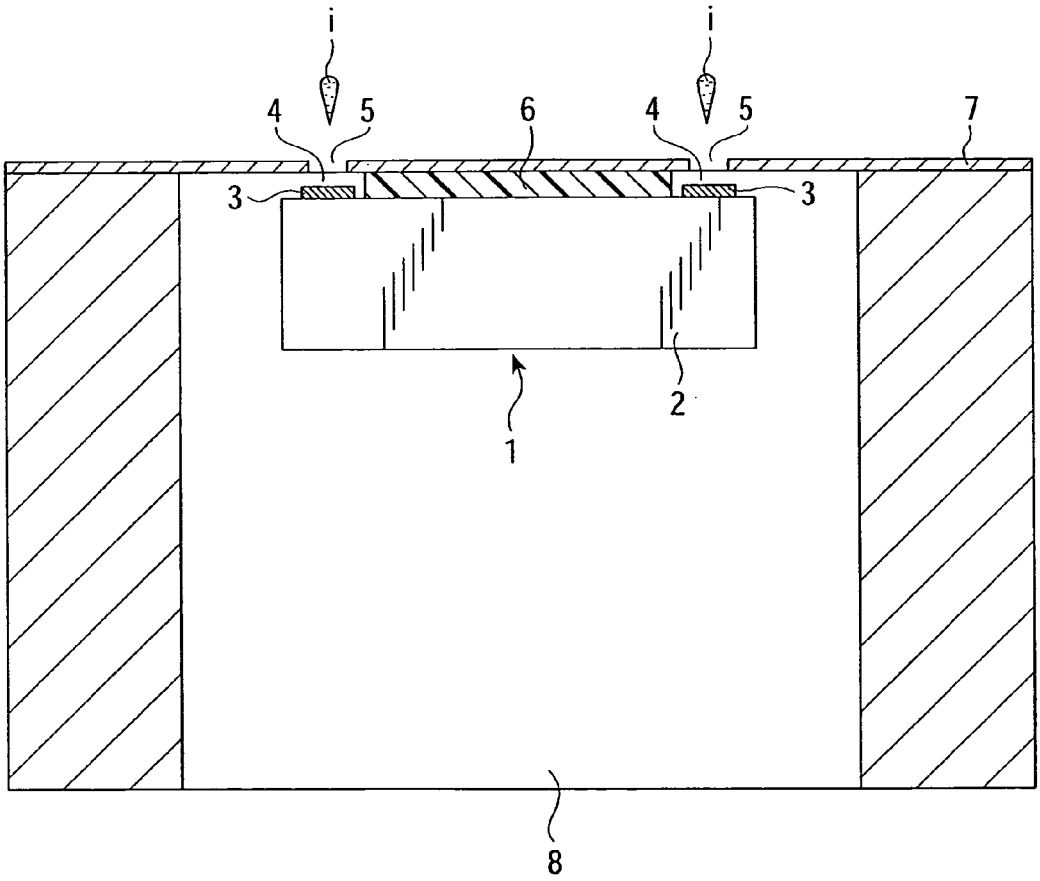
FIG. 11 is a sectional view of an example of a related printer head.

FIG. 10 illustrates a method of supplying ink to each printer head chip 10 of the color line printer head.

As shown in FIG. 10, first ink supplying means 70A, second ink supplying means 70B, third ink supplying means 70C, and fourth ink supplying means 70D are independently provided at printer head chip groups 60A to 60D, respectively. The ink supplying means 70A to 70D comprise ink tanks 71A to 71D and suction pumps 72 for suctioning ink, respectively.

The ink tanks 71A to 71D are filled with yellow (Y) ink, magenta (M) ink, cyan (C) ink, and black (B) ink, respectively.

Bubble removing filters (bubble removing means) 73 and dirt removing filters 74 are mounted to the corresponding ink supplying means 70A to 70D. The bubble removing filters 73 and the dirt removing filters 74 are provided to remove any bubbles and dirt in the recovered ink, respectively.

Each of the ink supplying means 70A to 70D and the ink flow path hole 23A of one printer head chip 10 in each of the corresponding printer head chip groups 60A to 60D (the printer head chip 10 disposed closest to each of the corresponding ink supplying means 70A to 70D) are connected together. In addition, in each of the printer head chip groups 60A to 60D, the ink flow path holes 23A and 23B of adjacent printer head chips 10 are connected together.

The ink flow path 23B of each printer head chip 10 disposed farthest from each of the corresponding ink supplying means 70A to 70D in each of the corresponding printer head chip groups 60A to 60D and its corresponding suction pump 72 side of each of the ink supplying means 70A to 70D are connected together.

By this, ink supplied from the ink tanks 71A to 71D of the corresponding ink supplying means 70A to 70D is supplied to all of the corresponding printer head chips 10 through the ink flow path holes 23A and 23B and the ink flow path grooves 22 of the printer head chips 10 of the corresponding printer head chip groups 60A to 60D. In this way, even for the case where a certain number of printer head chips 10 are disposed side by side when forming a line printer, the ink flow path holes 23A and 23B of adjacent printer head chips 10 only need to be connected so as to allow flow of ink.

Ink supplied to each of the printer head chips 10 of the printer head chip groups 60A to 60D is recovered by the suction pumps 72, and is returned to each of the ink tanks 71A to 71D (in FIG. 10, flow of ink represented by arrows).

By this, ink is circulated between each of the printer head chip groups 60A to 60D. Therefore, heat generated at the printer head chips 10 of each of the printer head chip groups 60A to 60D can be dissipated by each of the ink supplying means 70A to 70D, so that a cooling effect can be achieved.

Although, in the example shown in FIG. 10, the ink flow path holes 23A and 23B of adjacent printer head chips 10 are connected so as to allow flow of ink, the present invention is not limited to this structure. For example, only an ink flow path hole 23A is formed in one printer head chip 10 disposed closest to each of the corresponding ink supplying means 70A to 70D. In addition, only an ink flow path hole 23B is formed in one printer head chip 10 disposed farthest from each of the corresponding ink supplying means 70A to 70D.

The ink flow path holes 23A and 23B and each of the ink supplying means 70A to 70D are connected to together. As regards the other printer head chips 10 at intermediate locations, ink flow path holes 23A and 23B are not formed, so that only ink flow path grooves 22 are formed, with the ink flow path grooves 22 of adjacent printer head chips 10 being connected together. Even if the printer head chips 10 are formed in this way, similar advantages to those mentioned above can be provided.

When a color serial printer head is to be formed, one or a few printer head chips 10 may be provided instead of the printer head chip groups 60A to 60D in the example shown in FIG. 10. In that case, the ink supplying means 70A to 70D supply ink to the ink flow path groove 22 of one or the few printer head chips 10.

In the case where a color serial printer head is formed using one printer head chip 10, ink flow path holes 23A and 23B are formed in the printer head chip 10, and ink from each of the ink supplying means 70A to 70D is sent to the printer head chip 10 from the ink flow path hole 23A. In addition, the ink supplying means 70A to 70D and the ink flow path holes 23A and 23B are connected together so that ink is recovered from the ink flow path hole 23B by the corresponding ink supplying means 70A to 70D.

When a monochromatic line printer head is formed, it only needs to comprise black (B) ink supplying means 70D and a fourth printer head chip group 60D connected to the ink supplying means 70D so as to allow ink supply from the ink supplying means 70D, which are shown in the example shown in FIG. 10.

When a monochromatic serial printer head is formed, it only needs to comprise black (B) ink supplying means 70D, and one or a few printer head chips 10 including an ink flow path hole 23A for sending ink from the ink supplying means 70D and an ink flow path hole 23B for recovering ink by the ink supplying means 70D, which are shown in the example shown in FIG. 10.

As described above, in the printer head chip 10 and the printer head in the second embodiment, ink can be supplied by the printer head chip 10 alone. Therefore, it is not necessary to form an ink flow path 8 over the length of the printer head chip 1 independently of the printer head chip 1, externally of the printer head chip 1 as in the related example shown in FIG. 9. Therefore, it is possible to reduce the size of the printer head. In addition, since the structure of the printer head can be simplified, it is possible to make the printer head highly reliable.

Even in the case where a color printer head, having a plurality of printer head chips 10 disposed side by side, for discharging ink of a plurality of colors is formed or the case where a line printer head having a plurality of printer head chips 10 disposed in a line is formed, ink can be very easily supplied. In these cases, since the printer head chips 10 are highly independent, even if defects occur in some of the printer head chips 10, the printer head chips 10 can be singly replaced.

Since the printer head chips 10 have a structure which allows circulation of ink, heat generated at the printer head chips 10 can be dissipated by the ink supplying means 70A to 70D, so that a cooling effect can be achieved.

By circulating ink with the bubble removing filters 73 being provided in the ink supplying means 70A to 70D, it is possible to prevent improper discharge of ink drops in order to provide high print quality and not to waste ink during removal of bubbles.

By circulating ink with the dirt removing filters 74 being provided in the ink supplying means 70A to 70D, it is possible to supply ink purified at all times to the printer head chips 10, so that a high print quality can be achieved.

Although the second embodiment of the present invention has been described, the present invention is not limited to the second embodiment, so that various modifications such as those described below are possible.

(1) In the second embodiment, the ink flow path holes 23A and 23B are formed in both end portions of the ink flow path groove 22. The positions of the ink flow path holes 23A and 23B are not limited thereto, so that they can be arbitrarily set. In addition, a plurality of ink flow path holes 23A and 23B may be formed in one ink flow path groove 22.

(2) Although, in the second embodiment, the ink flow path groove 22 is formed parallel to and along one end portion of the substrate 20, the shape of the ink flow path groove 22 in the longitudinal direction is not limited thereto, so that the ink flow path groove 22 does not necessarily need to be formed with a linear shape.

Although the cross-sectional shape of the ink flow path groove 22 is a substantially concave shape, it is not limited thereto, so that the ink flow path groove 22 may be formed with various other shapes, such as a substantially V shape or a substantially U shape.

(3) Although, in the second embodiment, the ink flow path holes 23A and 23B have a linear shape that allows them to pass through the substrate 20 from the bottom end surface defining the ink flow path groove 22 to the back surface of the substrate 20, the shape is not limited thereto, so that they may have an L shape which is such as to connect a side surface of the substrate 20 and the bottom surface defining the ink flow path groove 22.

(4) The bubble removing filters 73 and the dirt removing filters 74 are provided when necessary, so that they do not necessarily have to be provided. The locations of the bubble removing filters 73 and the dirt removing filters 74 are not limited to those in the second embodiment, so that they may be provided at any other locations such as inside the ink supplying means 70A to 70D and paths that connect the ink supplying means 70A to 70D and the corresponding printer head chips 10.

(5) Although, in the second embodiment, a printer head chip 10 of a face shooter type, that is, of a type in which the nozzles 41 are formed in the top surface as shown in FIG. 9 is taken as an example, the type of printer head chip 10 is not limited thereto. The printer head chip 10 may also be an edge shooter type (in which the nozzles 41 are formed in a side surface of the printer head chip 10). In that case, for example, a sheet having no nozzles 41 is attached to the top surface of the printer head chip 10 instead of the nozzle sheet 40 shown in FIG. 9.

A nozzle sheet 40 having nozzles 41 formed in correspondence with the heat-generating resistors 21 is attached to a side surface of the substrate 20 shown in FIG. 9. By this, a printer head chip of an edge shooter type that discharges ink drops from a side surface of the substrate 20 can be formed.

In the above-described second embodiment, by forming an ink flow path groove in a printer head chip, ink can be supplied by the printer head chip alone. Therefore, it is not necessary to form an ink flow path over the length of the printer head chip independently of the printer head chip, externally of the printer head chip. Therefore, it is possible to reduce the size of the printer head.

It is possible to cause the ink in the printer head chip to circulate.

According to the second embodiment, it is possible to cause the ink inside the printer head chip group or the printer head chips to circulate by the ink supplying means. By this, heat generated at the printer head chips can be dissipated by the ink supplying means.

Since it is possible to remove bubbles by making use of the circulation of ink, compared to, for example, the method in which the bubbles are suctioned, the bubbles can be removed without wasting ink.

What is claimed is:

1. A printer head chip comprising a plurality of ink compressing chambers which include heat-generating resistors and which are disposed side by side on a substrate and the printer head chip being used to discharge ink inside the plurality of ink compressing chambers from a nozzle by driving the heat-generating resistors, the printer head chip including:

an ink flow path groove, which is formed in the substrate and which is connected to each of the ink compressing chambers, for supplying ink to each of the ink compressing chambers, an ink flow path hole which connects the ink flow path groove and the outside of the substrate, wherein the ink flow path hole is connected to an ink supplying means or an ink flow path hole of the other printer head chip.

2. A printer head chip according to claim 1, further including an ink flow path hole which connects the ink flow path groove and the outside of the substrate.

3. A printer head chip according to claim 1, further including a plurality of ink flow path holes which connect the ink flow path groove and the outside of the substrate, the plurality of ink flow path holes being formed in the ink flow path groove.

4. A printer head chip according to claim 1, further including an ink flow path hole which connects the ink flow path groove and the outside of the substrate, the ink flow path hole being formed at one longitudinal direction end portion in the ink flow path groove.

5. A printer head chip according to claim 1, further including a plurality of ink flow path holes which connect the ink flow path groove and the outside of the substrate, the plurality of ink flow path holes being formed at both longitudinal direction end portions in the ink flow path groove.

6. A printer head comprising:

a plurality of printer head chips each comprising a plurality of ink compressing chambers which include heat-generating resistors and which are disposed side by side on a substrate, each of the plurality of printer head chips including an ink flow path groove which is provided in the substrate, which connects to each of the corresponding ink compressing chambers, and which is used to supply ink to each of the corresponding ink compressing chambers, and an ink flow path hole which connects the ink flow path groove and the outside of the substrate, wherein the ink flow path hole is connected to an ink supplying means or an ink flow path hole of the other printer head chip;

the plurality of printer head chips being used to discharge the ink inside the plurality of ink compressing chambers from corresponding nozzles by driving the heat-generating resistors; and one nozzle sheet having the plurality of printer head chips disposed thereat and having the nozzles formed at locations corresponding to locations of the heat-generating resistors;

wherein the ink flow path grooves of the plurality of printer head chips are connected together.

7. A printer head according to claim 6, wherein each printer head chip further includes an ink flow path hole which connects the ink flow path groove corresponding thereto and the outside of the substrate.

8. A printer head according to claim 6, wherein each printer head chip further includes a plurality of ink flow path holes which connect the ink flow path groove corresponding thereto and the outside of the substrate, the plurality of ink flow path holes being formed in the ink flow path groove corresponding thereto.

9. A printer head according to claim 6, wherein each printer head chip further includes an ink flow path hole which connects the ink flow path groove corresponding thereto and the outside of the substrate, the ink flow path hole being formed at one longitudinal direction end portion in the ink flow path groove corresponding thereto.

10. A printer head according to claim 6, wherein each printer head chip further includes a plurality of ink flow path holes which connect the ink flow path groove corresponding thereto and the outside of the substrate, the plurality of ink flow path holes being formed at both longitudinal direction end portions in the ink flow path groove corresponding thereto.

11. A printer head according to claim 6, wherein the plurality of printer head chips are disposed at the nozzle sheet in a line in a longitudinal direction thereof.

12. A printer head according to claim 6, wherein the plurality of printer head chips are disposed at the nozzle sheet in a line in a longitudinal direction thereof, with at least one of the plurality of printer head chips including an ink flow path hole which connects the corresponding ink flow path groove and the outside of the substrate.

13. A printer head comprising:

a plurality of printer head chips each comprising a plurality of ink compressing chambers which include heat-generating resistors and which are disposed side by side on a substrate, each of the plurality of printer head chips including an ink flow path groove which is provided in the substrate, which connects to each of the corresponding ink compressing chambers, and which is used to supply ink to each of the corresponding ink compressing chambers, and the plurality of printer head chips being used to discharge the ink inside the plurality of ink compressing chambers from corresponding nozzles by driving the heat-generating resistors;

an ink flow path hole which connects the ink flow path groove and the outside of the substrate, wherein the ink flow path hole is connected to an ink supplying means or an ink flow path hole of the other printer head chip;

one nozzle sheet having the plurality of printer head chips disposed thereat and having the nozzles formed at locations corresponding to locations of the heat-generating resistors;

first ink supplying means for supplying ink to the ink flow path groove of one printer head chip; and second ink supplying means for supplying ink of a color which is different from a color of the ink supplied from the first ink supplying means to the ink flow path groove of another printer head chip.

14. A printer head according to claim 13, wherein each printer head chip further includes an ink flow path hole which connects the ink flow path groove corresponding thereto and the outside of the substrate.

15. A printer head according to claim 13, wherein each printer head chip further includes a plurality of ink flow path holes which connect the ink flow path groove corresponding thereto and the outside of the substrate, the plurality of ink flow path holes being formed in the ink flow path groove corresponding thereto.

16. A printer head according to claim 13, wherein each printer head chip further includes an ink flow path hole which connects the ink flow path groove corresponding thereto and the outside of the substrate, the ink flow path hole being formed at one longitudinal direction end portion in the ink flow path groove corresponding thereto.

17. A printer head according to claim 13, wherein each printer head chip further includes a plurality of ink flow path holes which connect the ink flow path groove corresponding thereto and the outside of the substrate, the plurality of ink flow path holes being formed at both longitudinal direction end portions in the ink flow path groove corresponding thereto.

* * * * *